US006443244B1

(12) United States Patent
Collins

(10) Patent No.: US 6,443,244 B1
(45) Date of Patent: Sep. 3, 2002

(54) BUOYANT DRILL PIPE, DRILLING METHOD AND DRILLING SYSTEM FOR SUBTERRANEAN WELLS

(75) Inventor: Gary J. Collins, Richmond, TX (US)

(73) Assignee: Marathon Oil Company, Findlay, OH (US)

( * ) Notice: Subject to any disclaimer, the term of this patent is extended or adjusted under 35 U.S.C. 154(b) by 0 days.

(21) Appl. No.: 09/607,690

(22) Filed: Jun. 30, 2000

(51) Int. Cl.[7] ..... E21B 7/04
(52) U.S. Cl. ..... 175/61; 175/62; 166/367
(58) Field of Search ..... 175/61, 62, 320, 175/76; 166/367

(56) References Cited

U.S. PATENT DOCUMENTS

| | | | | | |
|---|---|---|---|---|---|
| 1,764,488 | A | * | 6/1930 | Zublin | 175/325.3 |
| 1,781,049 | A | | 11/1930 | Brinton | |
| 2,352,412 | A | * | 6/1944 | Sandstone | 175/325.5 |
| 2,606,792 | A | | 8/1952 | Marsh | |
| 3,422,914 | A | | 1/1969 | Pomeroy | |
| 3,556,231 | A | | 1/1971 | Henderson | |
| 3,631,932 | A | | 1/1972 | Lindelof | |
| 3,709,294 | A | * | 1/1973 | Kilgore | 166/243 |
| 3,825,065 | A | | 7/1974 | Lloyd et el. | |
| 3,991,824 | A | | 11/1976 | Schuh | |
| 4,308,917 | A | | 1/1982 | Dismukes | |
| 4,484,641 | A | * | 11/1984 | Dismukes | 175/61 |
| 4,892,144 | A | * | 1/1990 | Coone | 277/334 |
| 4,909,327 | A | * | 3/1990 | Roche | 166/359 |
| 4,949,797 | A | | 8/1990 | Isom | |
| 4,997,048 | A | | 3/1991 | Isom | |
| 5,456,317 | A | | 10/1995 | Hood, III et al. | |
| 5,480,265 | A | | 1/1996 | Marshall et al. | |
| 5,647,434 | A | | 7/1997 | Sullaway et al. | |
| 5,971,075 | A | | 10/1999 | Odru et al. | |
| 6,155,748 | A | * | 12/2000 | Allen et al. | 405/195.1 |

OTHER PUBLICATIONS

"New Generation Inflatable Packing Elements," by R. K. Mody and M. P. Coronado, OTC 6755, Presented at the 23rd Annual Offshore Technology Conference in Houston, Texas, May 6–9, 1991, pp. 503–512.

"Inflatable Packers: Production Application," by M. D. Walsh and D. J. Holder, SPE 17443, Presented at the SPE California Regional Meeting in Long Beach, California, Mar. 23–25, pp. 401–412.

"Database Analysis of Thru–Tubing Inflatable Packer Systems," by M. P. Coronado, SPE 28487, Presented at the SPE 69th Annual Technical Conference and Exhibition in New Orleans, Louisiana, Sep. 25–28, 1994, pp. 249–262.

"Inflatable Packers Provide Options for Horizontal Wells," by Steve Ogden, Petroleum Engineer International, Nov. 1991, pp. 37–42.

Advertisement for No. 1 Balmoral Group, Ltd., Journal of Petroleum Technology, vol. 50, No. 1, Jan. 1998, p. 63.

* cited by examiner

*Primary Examiner*—Thomas B. Will
*Assistant Examiner*—Meredith C. Petravick
(74) *Attorney, Agent, or Firm*—Jack E. Ebel

(57) ABSTRACT

A buoyant drill pipe for drilling subterranean wells includes a tubular element, such as a length of metal pipe or tubing, and a buoyant element, such as an inflatable element, or a buoyant collar, attached to an outside diameter of the tubular element. The tubular element provides a conduit for injecting a drilling fluid into a well bore. The buoyant element interacts with the lo drilling fluid in the well bore to provide buoyancy for the drill pipe. The buoyant drill pipe can be used to construct a drilling system, and to perform a drilling method for an extended reach well bore having a horizontal or inclined segment. During drilling, the buoyant element interacts with the drilling fluid in the horizontal or inclined segment, such that a weight of the drill pipe, a torque required to rotate the drill pipe, and torsional stresses on the drill pipe are reduced.

29 Claims, 7 Drawing Sheets

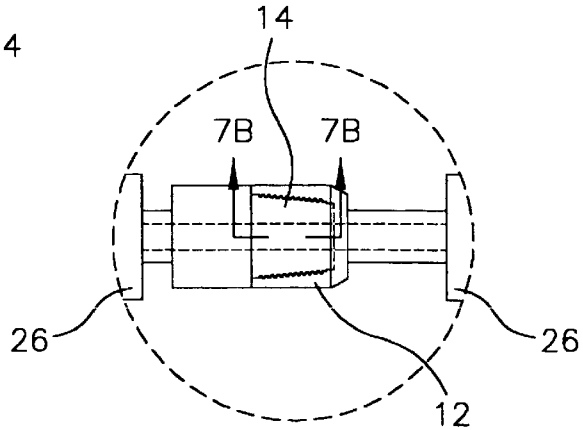
FIGURE 7A
FIGURE 7B
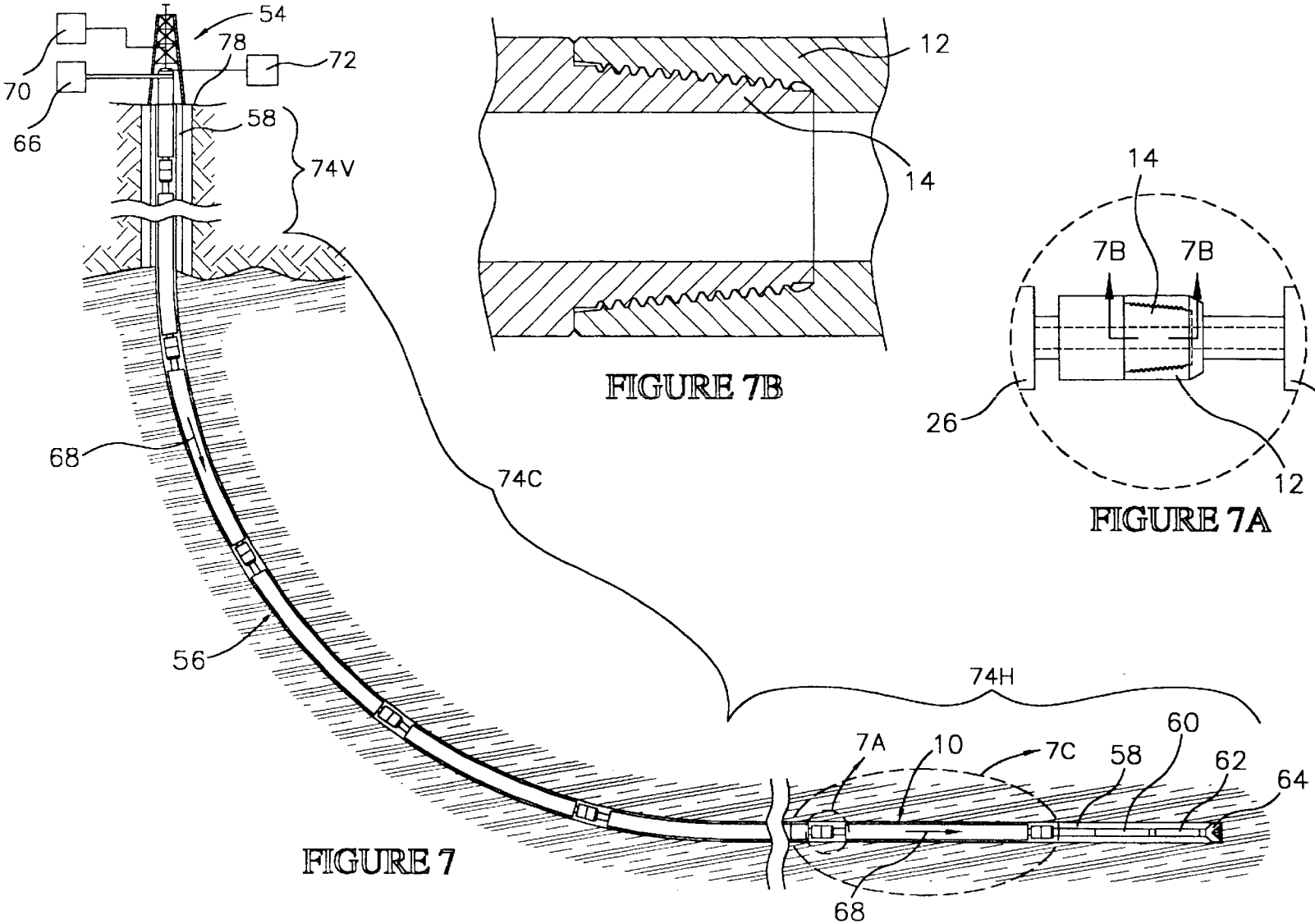
FIGURE 7

BUOYANT DRILL PIPE, DRILLING METHOD AND DRILLING SYSTEM FOR SUBTERRANEAN WELLS

FIELD OF THE INVENTION

This invention relates to the drilling of subterranean wells, such as oil and gas wells. More particularly, this invention relates to a buoyant drill pipe, to a drilling method employing the drill pipe, and to a drilling system incorporating the drill pipe.

BACKGROUND OF THE INVENTION

Extended reach wells have been drilled with increasing frequency in recent years to recover liquid and gaseous hydrocarbons from subterranean formations. In drilling an extended reach well, a generally vertical well bore is first drilled from the earthen or subsea surface to a depth approximating a subterranean formation of interest. The well bore is then deviated through a curved segment, and terminated in a horizontal segment or an inclined segment.

Depending upon the radius of curvature of the curved segment, the extended reach well is either completed open hole, or a casing is positioned in the vertical and horizontal or inclined segments, and cemented. The casing is then placed in fluid communication with the formation by perforating or other method. Alternately, a horizontal drainhole can be drilled from an existing well bore by milling a portion of the casing in place in the well bore, and then drilling the horizontal drain hole using a conventional drill string and bit.

Extended reach wells are often drilled in offshore fields to reach reservoirs located some distances from an existing platform or from land. In these situations it is usually cheaper to drill an extended reach well from the existing platform, or from land, to reach the additional reservoirs. The extended reach well saves the expense of building separate platforms directly over each reservoir in a field.

In view of these advantages, technology has been developed to facilitate drilling of extended reach wells, (i.e.., wells in which the ratio of the measured depth to the true vertical depth is at least 2.0). This technology is sometimes referred to as extended reach drilling ("ERD"). Using ERD, wells have been drilled with a maximum closure (i.e., directional reach of horizontal departure) of greater than about 18,000 ft., and a true vertical depth ("TVD") of about 4,500 ft.

One aspect of ERD is that current drilling equipment is limited by the service limits of the drill pipe. Presently, the maximum make up torque of steel drill pipe is about 65,000–70,000 foot/pounds. This limit is usually met at about 20,000 feet of maximum closure, and at about 6,000–6,500 TVD. Depending upon the maximum closure and true vertical depth of an extended reach well, the tensile strength of the drill pipe is often the limiting factor.

Drill string dynamics, such as friction, resulting from the rotation of the drill string by a rotary drive system, can also cause problems in ERD. For example, during rotation, the drill string can encounter resistance to free rotation from cuttings within the well bore, or from long sections of drill pipe rubbing against the well bore. With rotational resistance, higher torque forces must be placed on the drill string by the rotary drive system. Also during rotation, the drill string can wobble, increasing the torsional loads on the drill string.

One prior art approach to the problem of high torque requirements has been to make the drill pipe out of light weight materials, such as aluminum or titanium. The lighter drill pipe makes the drill string lighter, and easier to rotate, thus reducing torsional loads. However, this solution has not been totally satisfactory, as lightweight drill pipe is expensive, and lacks the durability of conventional steel drill pipe.

In other prior art drilling systems, the drill pipe has been made more buoyant by charging the drill pipe with a buoyant gas or fluid. This increased buoyancy reduces the weight of the drill pipe in relation to the column of fluid in which it is suspended, and decreases the rotational forces required to rotate the drill string. However, these prior art systems have not provided completely satisfactory results, particularly for ERD. Thus, a need exists for an improved drill pipe, and for an improved drilling method, in which the weight of the drill string, and torsional stresses on the drill string during drilling are reduced.

Another problem with ERD is that cleaning of formation cuttings from the well bore becomes increasingly difficult in the horizontal and inclined segments of the well. Larger diameter drill pipe has been employed to increase the quantities of drilling fluids flowing in the pipe, to facilitate removal of the cuttings from the well bore. However, such larger diameter drill pipe does not alleviate the problems associated with high torque resistance and drill string dynamics. Accordingly, a need exists for a drill pipe that improves the removal of formation cuttings from horizontal and inclined segments of the well bore.

In view of the foregoing, it is an object of the present invention to provide an improved drill pipe having an increased buoyancy, and which can be rotated with reduced torque and torsional stresses. It is still another object of the present invention to provide an improved drill pipe having an increased outside diameter, which increases the flow rate of drilling fluids, and facilitates cleaning of formation cuttings from the well bore. It is a further object of the present invention to provide an improved drilling method and an improved drilling system that employ a buoyant drill pipe.

SUMMARY OF THE INVENTION

In accordance with the present invention, a drill pipe, a drilling system and a drilling method for subterranean wells are provided. The drill pipe, drilling system and drilling method are particularly suited to drilling extended reach wells having horizontal or inclined segments.

The drill pipe, broadly stated, comprises a tubular element, such as a pipe or tube, having one or more buoyant elements attached thereto. The buoyant elements are configured to interact with a drilling fluid in the well bore to provide buoyancy for the drill pipe.

In a first embodiment, the drill pipe includes a tubular element with threaded connections at each end, and a buoyant inflatable element attached to an outside diameter of the tubular element. The threaded connections permit multiple drill pipes to be connected to one another, and to other drilling components, to form a drill string. The drill string provides a conduit for injecting the drilling fluid into the well bore, and also forms a well annulus for returning the drilling fluid to the surface with formation cuttings.

The inflatable buoyant element contains a buoyant fluid, such as a gas or a liquid, which increases the buoyancy of the drill string in the drilling fluid. The increased buoyancy decreases the weight of the drill string in the well bore, reduces the torque required to rotate the drill string, and reduces the rotational stresses on the drill string. This permits well bores with longer horizontal or inclined segments to be drilled. In addition, the inflatable element increases the outside diameter of the drill string, such that the well annulus is constricted, and the flow rate of the drilling fluid in the well annulus is increased. This facilitates removal of formation cuttings from the well bore by the drilling fluid. The drill pipe can also include an outer casing, or other mechanism, for limiting the outside diameter of the inflated inflatable buoyant element.

In a second embodiment, the drill pipe includes a tubular element, and a buoyant element in the form of a buoyant collar attached to an outside diameter of the tubular element. The buoyant collar can be made of a buoyant material, such as plastic, foam, or a composite material. In addition to providing buoyancy, the buoyant collar also reduces frictional forces between the drill string and the well bore. In a third embodiment the drill pipe includes a tubular element, and a buoyant collar having one or more pockets for containing a gas, or a second buoyant material. In a fourth embodiment the drill pipe includes a tubular element in the form of a coiled tube, and multiple buoyant elements attached at spaced intervals to the tubular element.

The drilling system includes the drill string formed by multiple connected buoyant drill pipes. The drilling system also includes a drill bit attached to the drill string, a rotary drive mechanism for rotating the drill string, and a source of a drilling fluid in flow communication with the drill string.

The drilling method, broadly stated, includes the steps of: providing a drill pipe comprising a tubular element and a buoyant element, connecting the drill pipe to a drill bit to form a drill string, rotating the drill string and the drill bit through an earthen formation while injecting a drilling fluid through the drill string into the well bore; and applying a buoyant force to the drill string by interaction of the buoyant element with the drilling fluid in the well bore.

BRIEF DESCRIPTION OF THE DRAWINGS

FIG. 7 is a schematic cross sectional view illustrating a drilling system incorporating the buoyant drill pipe of FIG. 1 and a drilling method performed using the drill pipe;

FIG. 7A is an enlarged view of a portion of the buoyant drill pipe taken along section line 7A of FIG. 7;

FIG. 7B is a cross sectional view of the buoyant drill pipe taken along section line 7B—7B of FIG. 7A:

DETAILED DESCRIPTION OF THE PREFERRED EMBODIMENTS

Figure 1:
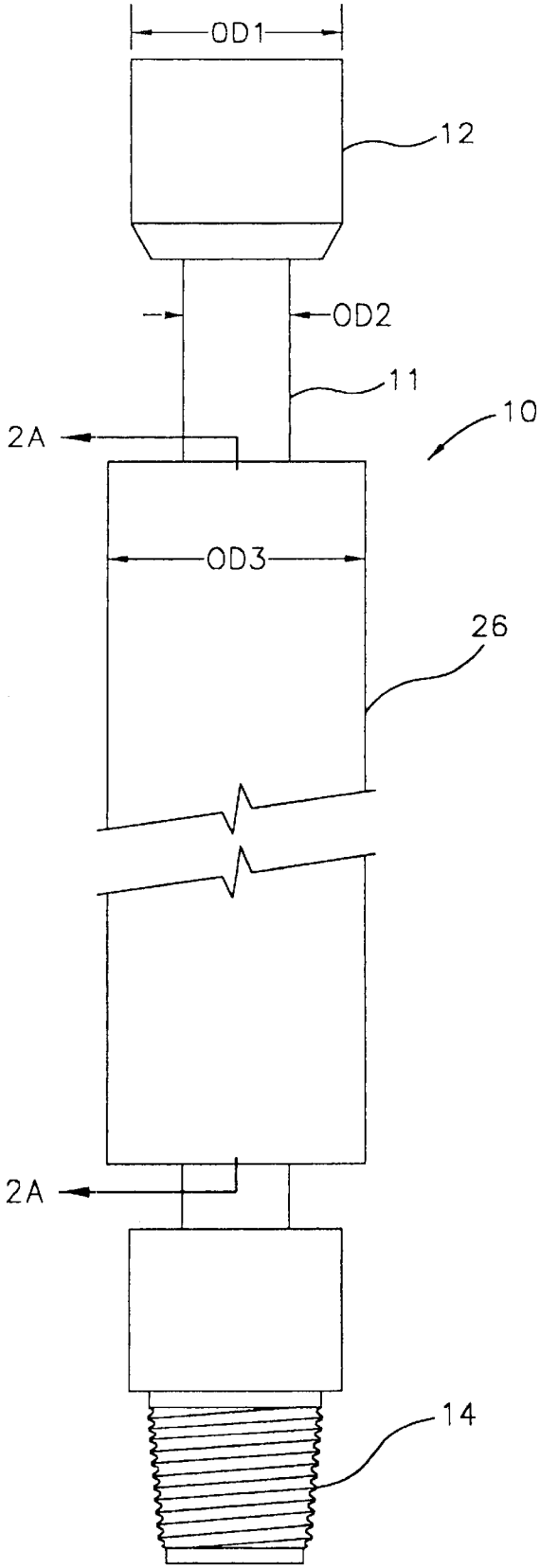
FIG. 1 is a side elevation view of a buoyant drill pipe having an inflatable buoyant element constructed in accordance with the invention.
Figure 2A:
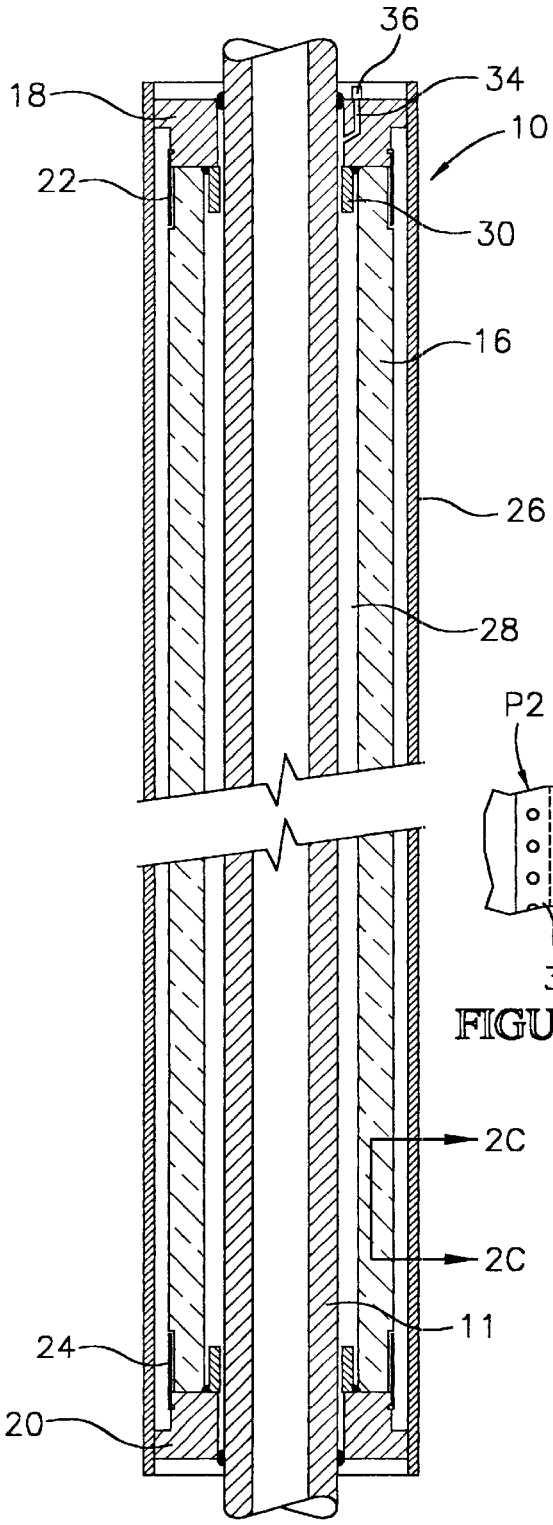
FIG. 2A is a cross sectional view taken along section line 2A—2A of FIG. 1 illustrating the buoyant drill pipe prior to inflation of the inflatable buoyant element.
Figure 2C:
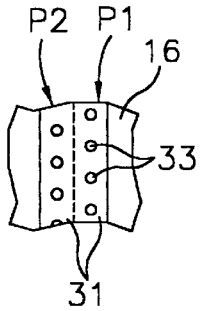
FIG. 2C is an enlarged cross sectional view taken along section line 2C—2C of FIG. 2A illustrating the construction of the inflatable buoyant element.
Figure 2B:
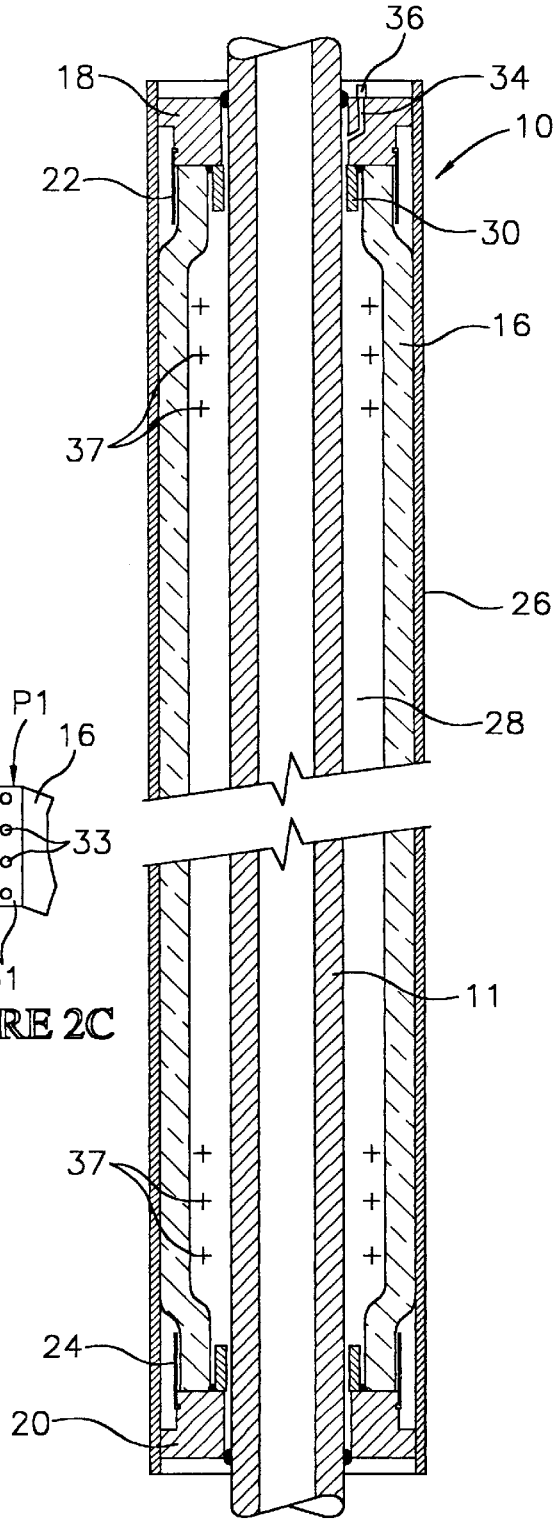
FIG. 2B is a cross sectional view equivalent to FIG. 2A but illustrating the drill pipe following inflation of the inflatable buoyant element.

Referring to FIGS. 1, 2A and 2B, a drill pipe 10 constructed in accordance with the invention is illustrated. As shown in FIG. 2A, the drill pipe 10 includes a tubular element 11, in the form of a length of metal pipe, or tubing, having a selected length (e.g., 10 feet to 40 feet). The tubular element 11 can be made of steel, aluminum, titanium or other suitable metal, or metal alloy. In addition, the outside diameter, the inside diameter, and the wall thickness of the tubular element 11 can be selected as required.

The tubular element 11 includes a threaded female connection 12 (box) at a first end, and a threaded male connection 14 (pin) at a second end. The threaded connections 12, 14 are also known in the art as "tool joints", with the female connection 12 being the "tool joint box", and the male connection 14 being the "tool joint pin". As is conventional, the outside diameter OD1 of the female connection 12 can be larger than an outside diameter OD2 of the tubular element 11.

The threaded connections 12, 14 can comprise high torque threaded tool joints having a selected thread geometry (e.g., API, Acme, NPT). The threaded connections 12, 14 are adapted for mating engagement with threaded connections on a second drill pipe, or another drill stem component. This permits multiple drill pipes 10 to be connected ("made up"), or separated, as required, to form a drill string for well drilling operations.

In addition to the tubular element 11, the drill pipe 10 also includes a buoyant element in the form of an inflatable element 16 (FIG. 2A), and an outer casing 26, attached to the tubular element 11. As clearly shown in FIG. 1, the inflatable element 16 and the outer casing 26 are spaced from the female connection 12, to provide access for a tool (not shown) configured to perform tool joint "makeup" and "breakout" procedures. One such tool is known as a "rotating mousehole tool". By way of example, the spacing of the inflatable element 16 (FIG. 2A) and the outer casing 26 from the female connection 12 can be about five feet or more.

FIG. 2A illustrates the inflatable element 16 prior to inflation. FIG. 2B illustrates the inflatable element 16 following inflation. The drill pipe 10 is adapted to be transported to a drill site in the uninflated condition of FIG. 2A, and then inflated at the drill site to the inflated condition of FIG. 2B. As will be further explained, following inflation, the inflatable element 16 increases the buoyancy of the drill pipe 10 during well drilling operations. In the embodiment illustrated in FIGS. 2A and 2B, the inflatable element 16 is similar in construction to an inflatable packer used for subterranean wells. However, it is to be understood that the illustrative construction of the inflatable element 16 is merely exemplary, and other arrangements can be employed.

The outer casing 26 is configured to limit the outside diameter of the inflated inflatable element 16 (FIG. 2B). The outer casing 26 can comprise a tube attached to the tubular element 11 in a manner to be hereinafter described. The outside diameter OD3 (FIG. 1) of the outer casing 26 must be less than the inside diameter of the well bore being drilled. Preferably, the outside diameter OD3 (FIG. 1) is approximately equal to, or slightly greater than, the outside diameter OD1 (FIG. 1) of the female connection 12. The outer casing 26 can be made of metal, plastic or a composite material having a relatively thin wall thickness. With the outer casing 26 made with a thin wall thickness, the outside diameter OD3 of the outer casing 26 is approximately equal to the outside diameter of the inflated inflatable element 16 (FIG. 2B).

Further, the outer casing 26 can be configured to reduce friction in situations where the outer casing 26 rubs against, or otherwise contacts, the well bore during rotation thereof. For example the outer casing 26 can be made of a friction reducing material such as plastic. Alternately, the outer casing 26 can include a separately deposited outer layer (not shown) which comprises a polymer, such as "TEFLON", or other material, configured to reduce friction upon contact with the well bore.

As shown in FIG. 2C, the inflatable element 16 can comprise a resilient elastomeric material 31 such as vulcanized rubber, neoprene, nitrile, a fluorocarbon such as "VITON" by Dupont, or any other suitable elastomeric compound used in the 15 art to make packers. In addition, the inflatable element 16 can include reinforcing cords 33, or cables, made of polyester, nylon, rayon, steel, "Kevlar" or other suitable materials. Further, the inflatable element 16 can be formed as a multi layered structure which comprises separate plies P1, P2 of the resilient elastomeric material 31 vulcanized to form a unitary structure.

The inflatable element 16 can also be constructed to "lock" at a required outside diameter, when inflated to a selected inflation pressure. Such an arrangement would permit the outer casing 26 to be eliminated. One method of constructing the inflatable element 16 to "lock", is to fabricate the reinforcing cords 31 of a material selected to elongate by a certain amount, and permit only a required amount of expansion during inflation of the inflatable element 16. For example, a material such as steel or "Kevlar" is relatively inelastic and would permit only a limited expansion of the inflatable element 16.

As another locking configuration, alternating plies P1, P2 can include reinforcing cord oriented at different helical angles with respect to a longitudinal axis of the inflatable element 16. For example, a first ply can include reinforcing cords oriented at a helical angle of "a", and a second ply can include reinforcing cords oriented at a helical angle of "−a". Such an arrangement would form an alternating "criss cross" structure that allows the inflatable element 16 to expand to a required outside diameter at a selected inflation pressure.

As shown in FIGS. 2A and 2B, the inflatable element 16 can be attached to the tubular element 11 by a pair of collars 18, 20, and a pair of crimp collars 22, 24 crimped to the collars 18, 20. The collars 18, 20 can be welded to the drill pipe 10, and the crimp collars 22, 24 can be crimped to the inflatable element 16 and collars 18, 20, using techniques that are known in the art. In addition, a packer barb 30 can also be provided between the inflatable element 16 and the tubular element 11 to facilitate the inflation process. In particular, the packer barb 30 spaces the inflatable element 16 from the tubular element 11 such that an inflation annulus 28 is provided.

In addition, a passage 34 in the collar 18, and a valve 36 attached to the collar 18, are also in fluid communication with the annulus 28. The valve 36 can comprise a conventional Shroeder valve (or similar valve), that permits an inflation fluid 37 (FIG. 2B) to be injected through the valve 36 into the annulus 28 for inflating the inflatable element 16. Following inflation, the valve 36 prevents the inflation fluid 37 from discharging until the valve 36 is opened.

Figure 7C:
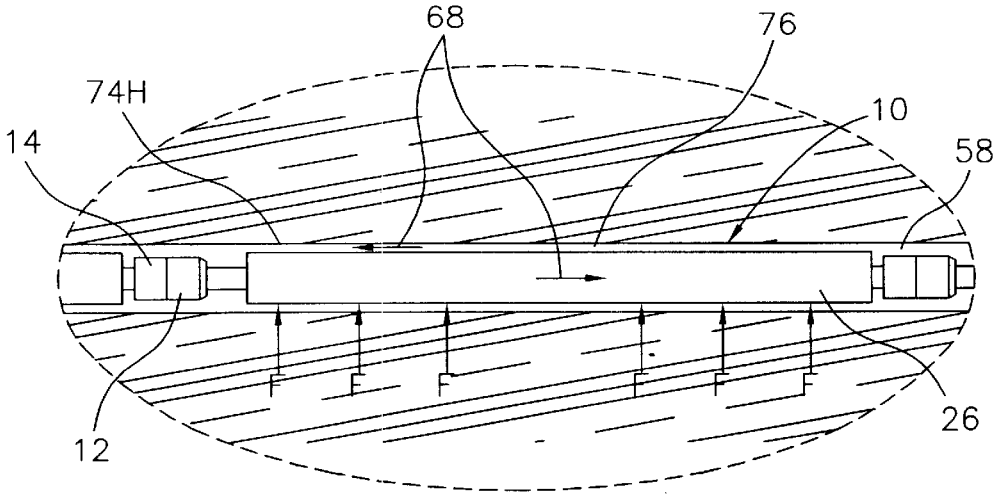
FIG. 7C is an enlarged view of a portion of FIG. 7 taken along section line 7C illustrating operational characteristics of the buoyant drill pipe in a horizontal segment of a well bore.

As will be further explained, the inflation fluid 37 must have a density that is less than the density of a drilling fluid 68 (FIG. 7C) used for drilling a well bore 58 (FIG. 7C). The less dense inflation fluid 37 makes the drill pipe 10 buoyant in the drilling fluid 68. Preferably, the inflation fluid 37 comprises a compressed gas, such as air or an inert gas, or a light weight liquid such as an oil.

In addition to attaching the inflatable element 16 to the tubular element 11, the collars 18, 20 also attach the outer casing 26 to the tubular element 11. The outer casing 26 can be press fitted, welded, threaded or other wise attached to the collars 18, 20. The outer casing 26 can also be constructed as a two piece member to facilitate attachment to the tubular element 11.

Figure 3:
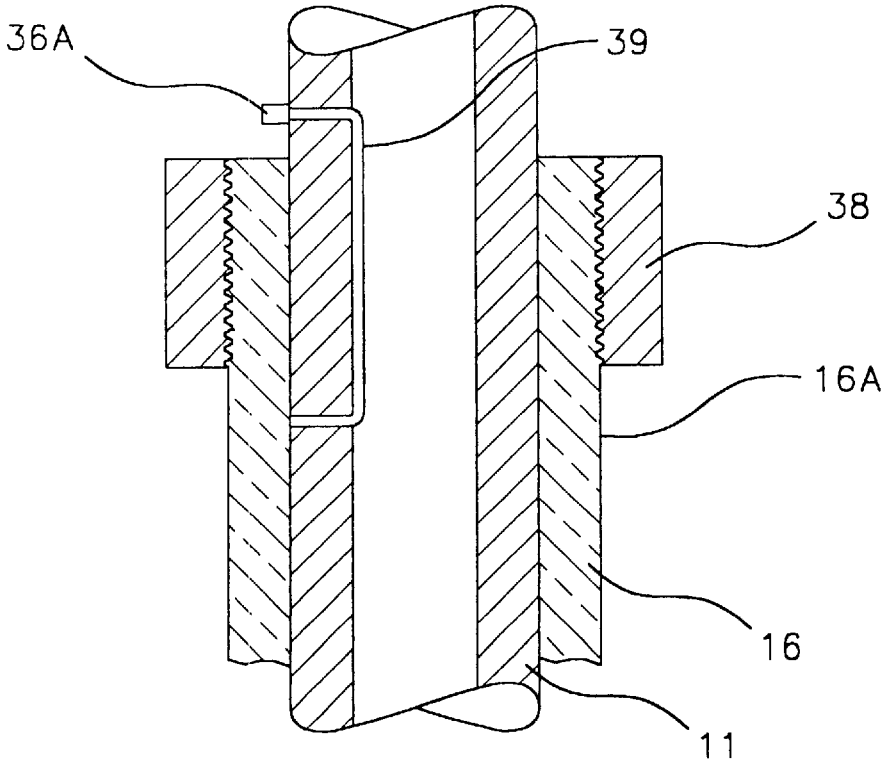
FIG. 3 is a cross sectional view of an alternate arrangement for securing the inflatable element to the drill pipe using a serrated collar.

Referring to FIG. 3, an alternate arrangement for attaching the inflatable element 16 to the tubular element 11 is illustrated. Specifically, serrated collars 38 at either end of the inflatable element 16 attach the inflatable element 16 to the tubular element 11. The serrated collars 38 can be crimped, or otherwise attached, to the inflatable element 16 and to the tubular element 11. In addition, a J-tube 39 is placed through openings in the walls of the tubular element 11 to provide a conduit for inflating the inflatable element 16. The J-tube also includes a valve 36A, substantially as previously described, which is located on the outside diameter of the tubular element 11 proximate to one of the collars 38.

Figure 4:
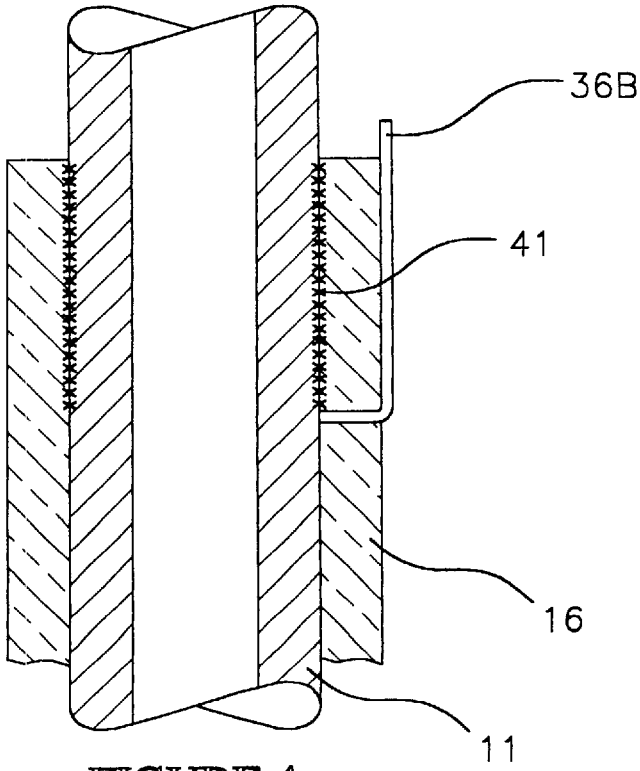
FIG. 4 is a cross sectional view of another alternate arrangement for securing the inflatable element to the drill pipe using a vulcanizing process.

Referring to FIG. 4, another alternate arrangement for attaching the inflatable element 16 to the tubular element 11 is illustrated. Specifically the inflatable element 16 is vulcanized to the tubular element 11 by forming a vulcanized layer 41 at each end of the inflatable element 16. In addition a valve 36B, substantially as previously described, is attached directly to the inflatable element 16.

Figure 5:
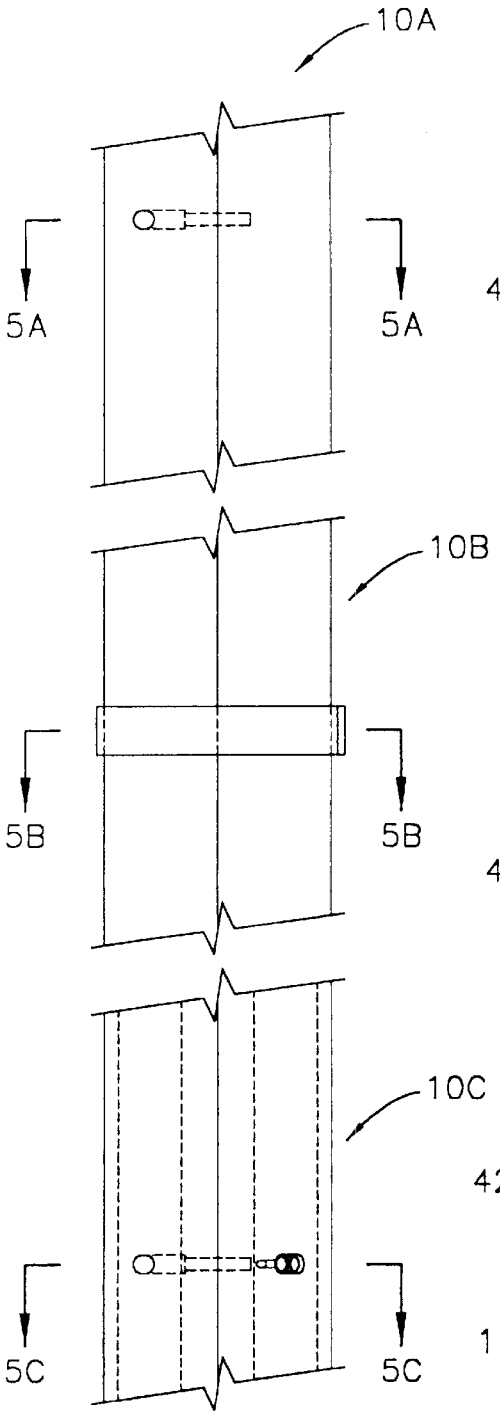
FIG. 5 is a schematic side elevation view illustrating alternate embodiments of the buoyant drill pipe.
Figure 5A:
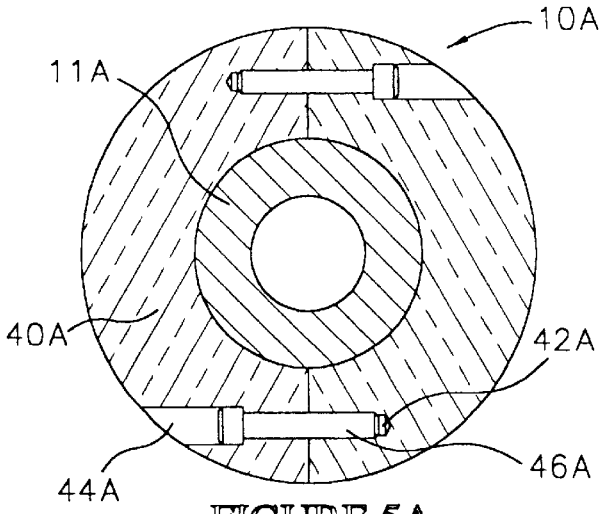
FIG. 5A is a cross sectional view taken along section line 5A—5A of FIG. 5 illustrating an alternate embodiment buoyant drill pipe having a buoyant element clamped to the drill pipe.

Referring to FIGS. 5–5A, alternate embodiment drill pipes 10A–10C are illustrated. In FIG. 5A a drill pipe 10A includes a tubular element 11A, and a buoyant element in the form of a buoyant collar 40A clamped to the tubular element 11A. The buoyant collar 40A is split in the longitudinal direction, such that it can be placed over the outside diameter of the tubular element 11A. In addition, the buoyant collar 40A includes threaded holes 42A and countersunk openings 44A for threaded fasteners 46A. This arrangement allows the buoyant collar 40A to be clamped to the tubular element 11A.

As with the previous embodiment, the buoyant collar 40A has an outside diameter that is less than the well bore in which the drill pipe 10A is to be used. In addition, the buoyant collar 40A comprises a material having a density that is less than the density of the drilling fluid 68 (FIG. 7C). Preferably the buoyant collar 40A comprises a relatively rigid material to resist stresses and deformation during the drilling process. However, for some applications the buoyant collar 40A can be made of a relatively flexible material. Suitable materials for the buoyant collar 40A include lightweight plastic materials such as polyethylene, polyvinyl chloride, ABS polymers, polypropelene, polyesters, phenolics or epoxies. The buoyant collar 40A can also comprise a composite material.

Figure 5B:
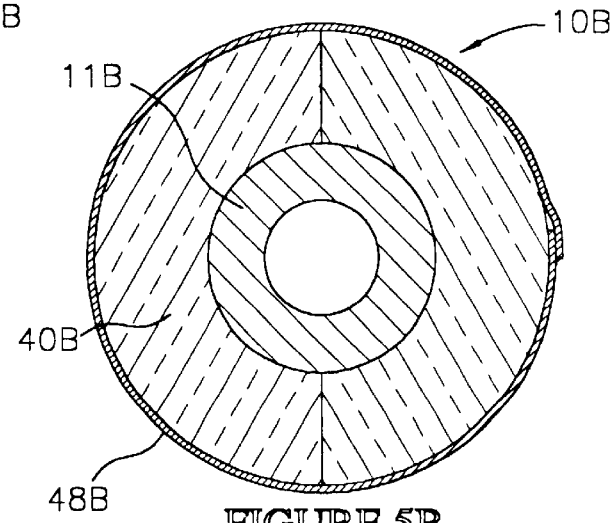
FIG. 5B is a cross sectional view taken along section line 5B—5B of FIG. 5 illustrating an alternate embodiment buoyant drill pipe having a buoyant element strapped to the drill pipe.

In FIG. 5B, a drill pipe 10B includes a tubular element 11B, and a buoyant element in the form of a buoyant collar 40B attached to the tubular element 11B using straps 48B. The buoyant collar 40B can be made of a rigid, lightweight plastic material as previously described. The straps 48B can comprise metal straps placed around the buoyant collar 40B and then secured by welding or other fastening mechanism.

Figure 5C:
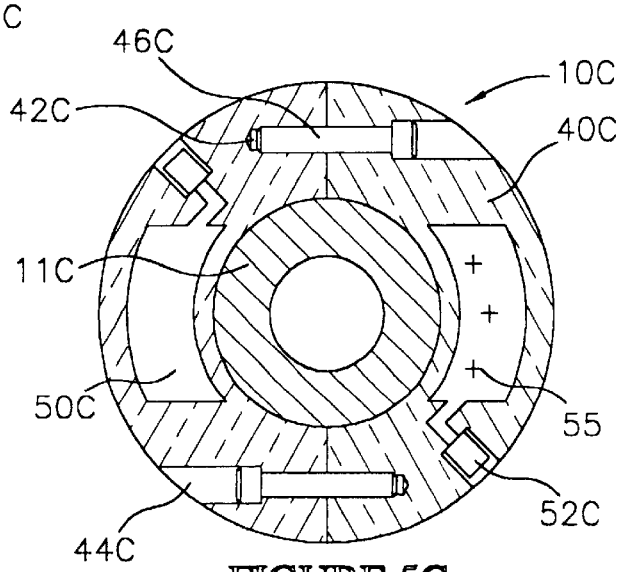
FIG. 5C is a cross sectional view taken along section line 5C—5C of FIG. 5 illustrating an alternate embodiment buoyant drill pipe with a buoyant element having chambers filled with a buoyant material.

In FIG. 5C, a drill pipe 10C includes a tubular element 11C and a buoyant element in the form of a buoyant collar 40C. The buoyant collar 40C includes threaded holes 42C and countersunk openings 44V for receiving threaded fasteners 46C. In addition, the buoyant collar 40C includes pockets 50C, wherein a gas 55, such as air or nitrogen, is held at a relatively low pressure. The buoyant collar 40C also includes valves 52C, similar to the valve 26 previously described, for filling the pockets 50C with the gas 55. Rather than being filled with a gas 55, the pockets 50C can be filled with a buoyant material such as polyurethane, rubber latex, or polyethylene.

Figure 6:
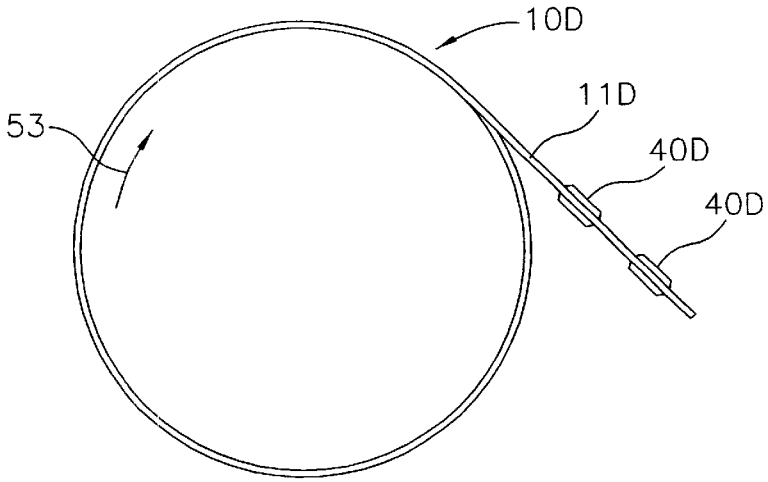
FIG. 6 is a schematic plan view of an alternate embodiment buoyant drill pipe formed by a coil of tubing and spaced buoyant elements.

Referring to FIG. 6, a drill pipe 10D includes a coiled tubular element 11D, such as a coil of tubing, that can be unwound during placement into a well bore as indicated by directional arrow 53. In addition, the drill pipe 10D includes a plurality of buoyant elements 40D that are attached to the tubular element 11D at spaced intervals. The buoyant elements 40D can be constructed and attached as previously described for buoyant collars 40A–40C. In addition, the length and spacing of the buoyant elements 40D can be selected as required.

Referring to FIG. 7, a drilling system 54 constructed in accordance with the invention, and a drilling method performed in accordance with the invention, are illustrated. In FIG. 7, the system 54 and method are used to drill an extended reach well bore 58 from an earthen or subsea surface 78. The extended reach well bore 58 includes a cased generally vertical segment 74V, a curved segment 74C, and a generally horizontal segment 74H. As used herein the term "horizontal segment" refers to a portion of a well bore that extends laterally, or generally orthogonally from a true vertical center line through an earthen formation.

The system 54 includes multiple buoyant drill pipes 10, that have been inflated and connected to one another to form a drill string 56. Alternately the system and method can be formed using alternate embodiment drill pipes 10A–10D. As shown in FIGS. 7A and 7B, the drill pipes 10 are connected by coupling the male connections 14 and the female connections 12 on adjacent drill pipes 10. Conventional tool joint makeup and breakout tools that are known in the art can be used to couple the connections 12, 14. The lower end of the drill string 56 includes a MWD (measurement while drilling) tool 60 and a drill bit 64. However, the MWD tool 60 is optional, as the method of the invention can be practiced without the MWD tool 60. The system 54 also includes a rotary drive mechanism 66 for rotating the drill string 56 and the drill bit 64. Optionally, a downhole motor 62 can be provided for rotating the drill bit 64 independently without having to rotate the drill string 56.

The system 54 also includes a drilling fluid source 70 in flow communication with the inside diameter of the drill string 56. The drilling fluid source 70 is adapted to inject the drilling fluid 68 through the drill string 56 and through the drill bit 64 into the well bore 58. The drilling fluid 68 then flows in a well annulus 76 between the drill bit 64 and the well bore 58, to the surface 78. The drilling fluid 68 in the well annulus 76 removes formation cuttings produced by the drill bit 64 in making the well bore 58.

The system 54 also includes an inflation source 72 on the surface 78 for inflating the inflatable elements 16 of the drill pipes 10 from the uninflated condition of FIG. 2A to the inflated condition of FIG. 2B. The inflation source 72 can comprise a source of compressed gas, such as air, or a pressurized fluid such as oil. As shown in FIG. 7C, the outer casings 26 of the drill pipes 10 also constrict the well annulus 76. This increases the flow velocity of the drilling fluid 68 in the well annulus 76, such that removal of formation cuttings from the well bore 58 is facilitated.

The inflated drill pipes 10 also have a buoyancy in the drilling fluid 68 flowing in the well annulus 76. This buoyancy is provided by the inflation fluid 37 (FIG. 2B) within the inflatable element 16 (FIG. 2B) interacting with the drilling fluid 68. As used herein, the term "buoyancy" refers to an upward pressure exerted by the drilling fluid 68 on the drill pipes 10. As used herein, the term "buoyant" refers to the power of the drill pipes 10 to float or rise in the drilling fluid 68.

As shown in FIG. 7C, the drill pipes 10 are in physical contact with the drilling fluid 68 such that upward pressure forces F are applied to the drill pipes 10. In the horizontal segment 74H, the pressure forces F are generally normal or orthogonal to the drill pipes 10. The pressure forces F make the drill string 56 lighter, such that the rotary drive mechanism 66 can rotate the drill string 56 with less torque. Accordingly, torsional stresses on the drill pipes 10 and the connections 12, 14 are reduced. This permits well bores 58 with longer horizontal segments 74H (or alternately longer inclined segments) to be drilled.

Also, depending on the material used to construct the inflatable elements 16 (or the buoyant collars 40A–40D), less friction is generated between the drill pipes 10 and the well bore 58 where rubbing occurs. For example, some elastomeric materials, particularly rigid plastics, have coefficients of friction on well bore surfaces that are less than with conventional metal drill pipes. The reduced friction decreases the torque loads required to rotate the drill string 56, and reduces stresses on the drill pipes 10 and connections 12, 14.

Figure 7D:
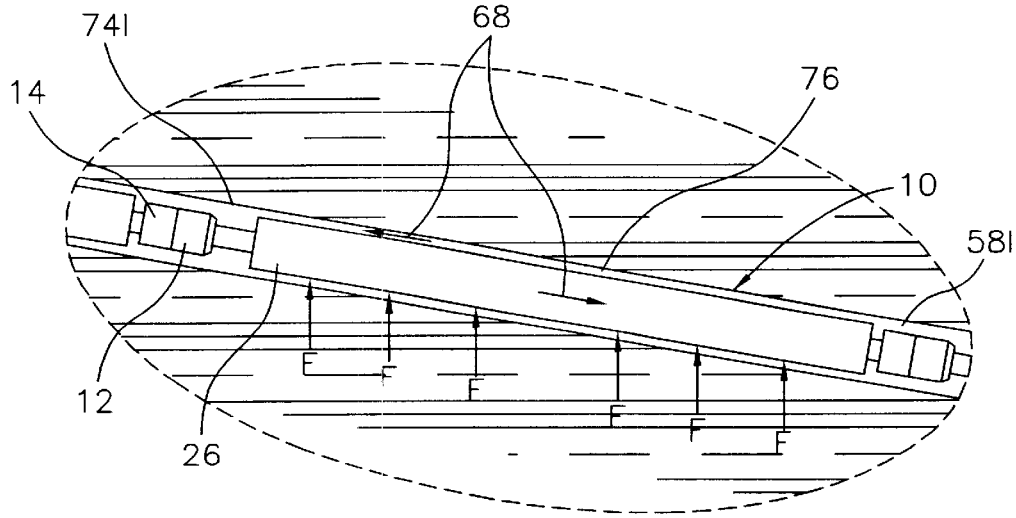
FIG. 7D is an enlarged view equivalent to FIG. 7C but illustrating an inclined segment of a well bore.

Although the system 54 is illustrated with the generally horizontal segment 74H, it is to be understood that the invention can also be practiced on well bores having inclined segments. As used herein the term "inclined segment" refers to a portion of a well bore that is angled with respect to a true vertical center line from the surface 78. For example, an inclined segment can have an angle with respect to the true center line of from 1° to 90° or more. FIG. 7D illustrates a well bore 581 with an inclined segment 741. In this case the buoyancy forces F are angled with respect to the drill pipe 10, rather than being normal as with the horizontal segment 74H (FIG. 7D).

Figure 8A:
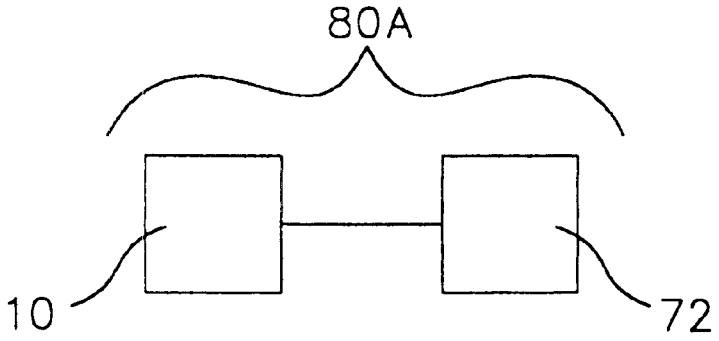
FIGS. 8A and 8B are schematic diagrams of kits that include drill pipes constructed in accordance with the invention.

Referring to FIG. 8A, a kit 80A constructed in accordance with the invention is illustrated schematically. The kit 80A can be transported to the drill site and then assembled at the drill site. The kit 80A includes the drill pipes 10 and an inflation source for inflating the inflatable elements 16 of the drill pipes 10.

Figure 8B:
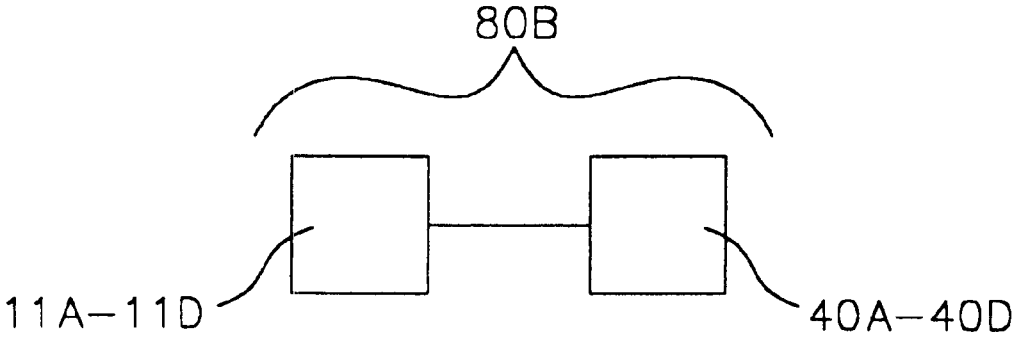

Referring to FIG. 8B, a kit 80B constructed in accordance with the invention is illustrated schematically. The kit 80B can be transported to the drill site and then assembled at the drill site. The kit 80A includes the tubular elements 11A–11D, and the buoyant collars 40A–40C, or buoyant element 40D.

Thus the invention provides a buoyant drill pipe, a drilling system and a drilling method for subterranean wells, particularly extended reach wells having horizontal or inclined segments. While the invention has been described with reference to certain preferred embodiments, as will be apparent to those skilled in the art, certain changes and modifications can be made without departing from the scope of the invention as defined by the following claims.

What is claimed is:

1. A method for drilling a subterranean well bore comprising:

connecting a drill pipe to a drill bit to form a drill string, the drill pipe comprising at least one tubular element and at least one buoyant element;

rotating the drill string through an earthen formation while injecting a drilling fluid through the drill string into the well bore; and applying a buoyant force to the drill string in a horizontal segment of the well bore by interaction of the buoyant element with the drilling fluid in the well bore.

2. The method of claim 1 wherein the applying step is also performed in a vertical segment of the well bore.

3. The method of claim 1 wherein the buoyant element comprises a buoyant collar attached to the tubular element.

4. The method of claim 1 wherein the buoyant element comprises a collar having a pocket adapted to contain a gas or a buoyant material.

5. A method for drilling an extended reach subterranean well comprising:

providing a plurality of drill pipes comprising tubular elements and buoyant elements attached to the tubular elements;

attaching the drill pipes to one another and to a drill bit to form a drill string;

rotating the drill string through an earthen formation to form a well bore and a well annulus;

injecting a drilling fluid through the drill string into the well bore and into the well annulus; and applying a buoyant force to the drill string by interaction of the buoyant element with the drilling fluid in the well annulus in a generally horizontal or inclined segment of the well.

6. The method of claim 5 further comprising forming the buoyant elements of a material selected to reduce friction during contact of the buoyant element with the well bore.

7. A method for drilling an extended reach subterranean well comprising:

providing a plurality of drill pipes comprising tubular elements and buoyant elements attached to the tubular elements;

attaching the drill pipes to one another and to a drill bit to form a drill string;

rotating the drill string through an earthen formation to form a well bore thereby defining a well annulus between the drill string and the well bore; and injecting a drilling fluid through the drill string into the well annulus such that the buoyant elements are in physical contact with the drilling fluid in the well annulus to provide a buoyant force on the drill string in a generally horizontal or inclined segment of the well.

8. The method of claim 7 further comprising forming the buoyant elements of material selected to reduce friction during contact of the buoyant element with the well bore.

9. A method for drilling an extended reach subterranean well comprising:

attaching a plurality of drill pipes to one another and to a drill bit to form a drill string, said plurality of drill pipes comprising tubular elements and inflatable buoyant elements which are attached to the tubular elements;

inflating the inflatable buoyant element with an inflation fluid;

rotating the drill string through an earthen formation to form a well bore; and injecting a drilling fluid through the drill string into the well bore such that the inflatable buoyant elements provide a buoyant force in the drilling fluid which acts to lighten and decrease torsional stresses on the drill string.

10. The method of claim 9 further comprising controlling inflated diameters of the inflatable buoyant elements in the well bore.

11. The method of claim 9 further comprising providing the drill pipes with outer casings configured to limit inflated diameters of the inflatable buoyant elements in the well bore.

12. A system for drilling a subterranean well comprising:

a source of a drilling fluid;

a drill string comprising a buoyant drill pipe in fluid communication with the source and a drill bit attached to the drill pipe;

a rotary drive mechanism for rotating the drill string through an earthen formation to form a well bore; and an inflation source for inflating the element with a buoyant fluid;

the drill pipe comprising at least one tubular element providing a conduit for injecting the drilling fluid into the well bore and at least one inflatable buoyant element attached to the at least one tubular element;

the at least one inflatable buoyant element configured to provide buoyancy for the drill string.

13. The system of claim 12 wherein the inflatable buoyant element comprises a buoyant collar attached to the tubular element.

14. A method for drilling a subterranean well bore comprising:

connecting a drill pipe to a drill bit to form a drill string, said drill pipe comprising at least one tubular element and at least one buoyant element;

rotating the drill string through an earthen formation while injecting a drilling fluid through the drill string into the well bore; and applying a buoyant force to the drill string in an inclined segment of the well bore by interaction of the buoyant element with the drilling fluid in the well bore.

15. The method of claim 14 wherein wherein the applying step is also performed in a vertical segment of the well bore.

16. The method of claim 14 wherein the buoyant element comprises an inflatable element attached to the tubular element and configured to contain a buoyant fluid.

17. The method of claim 14 wherein the buoyant element comprises a buoyant collar attached to the tubular element.

18. The method of claim 14 wherein the buoyant element comprises a collar having a pocket adapted to contain a gas or a buoyant material.

19. A method for drilling a subterranean well bore comprising:

connecting a drill pipe to a drill bit to form a drill string, said drill pipe comprising at least one tubular element and at least one inflatable element which is attached to the tubular element and configured to contain a buoyant fluid;

rotating the drill string through an earthen formation while injecting a drilling fluid through the drill string into the well bore; and applying a buoyant force to the drill string by interaction of the buoyant element with the drilling fluid in the well bore.

20. The method of claim 19 wherein the well bore comprises a horizontal segment wherein the applying step is performed.

21. The method of claim 19 wherein the well bore comprises an inclined segment wherein the applying step is performed.

22. The method of claim 19 wherein the well bore comprises a vertical segment wherein the applying step is performed.

23. The method of claim 19 wherein the inflatable element comprises a collar having a pocket adapted to contain a gas or a buoyant material.

24. A system for drilling a subterranean well comprising:

a source of a drilling fluid;

a drill string comprising a buoyant drill pipe in fluid communication with the source and a drill bit attached to the drill pipe;

a rotary drive mechanism for rotating the drill string through an earthen formation to form an extended reach well bore;

the drill pipe comprising at least one tubular element providing a conduit for injecting the drilling fluid into the well bore and at least one buoyant element attached to the at least one tubular element;

the at least one buoyant element configured to provide buoyancy for the drill string in a generally horizontal or inclined segment of the well bore.

25. The system of claim 24 wherein each of the at least one buoyant element comprises an inflatable element and the system further comprises an inflation source for inflating the inflatable element with a buoyant fluid.

26. The system of claim 24 wherein each of the at least one buoyant element comprises a buoyant collar attached to one of the at least one tubular element.

27. The system of claim 24 wherein each of the at least one buoyant element comprises an inflatable element and the drill pipe comprises an outer casing configured to limit an inflated diameter of the inflatable element.

28. A system for drilling a subterranean well comprising:

a source of a drilling fluid;

a drill string comprising a buoyant drill pipe in fluid communication with the source and a drill bit attached to the drill pipe; and a rotary drive mechanism for rotating the drill string through an earthen formation to form a well bore;

the drill pipe comprising at least one tubular element providing a conduit for injecting the drilling fluid into the well bore, at least one inflatable buoyant element attached to the at least one tubular element and at least one outer casing configured to limit an inflated diameter of the at least one inflatable buoyant element;

the at least one inflatable buoyant element configured to provide buoyancy for the drill string.

29. The system of claim 28 wherein the well bore comprises an extended reach well bore having a generally horizontal or inclined segment wherein the buoyant element interacts with the drilling fluid.

* * * * *